US010586496B2

(12) United States Patent
Kim et al.

(10) Patent No.: US 10,586,496 B2
(45) Date of Patent: Mar. 10, 2020

(54) DISPLAY DEVICE AND METHOD OF DRIVING THE SAME

(71) Applicant: Samsung Display Co., Ltd., Yongin-si, Gyeonggi-do (KR)

(72) Inventors: Jitae Kim, Yongin-si (KR); Jihye Kim, Seoul (KR); Woori Seo, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/948,200

(22) Filed: Apr. 9, 2018

(65) Prior Publication Data

US 2018/0293944 A1 Oct. 11, 2018

(30) Foreign Application Priority Data

Apr. 10, 2017 (KR) ..... 10-2017-0046243

(51) Int. Cl.
*G09G 3/3233* (2016.01)
*G09G 3/3266* (2016.01)
*G09G 3/3275* (2016.01)

(52) U.S. Cl.
CPC ..... *G09G 3/3266* (2013.01); *G09G 3/3233* (2013.01); *G09G 3/3275* (2013.01); *G09G 2310/08* (2013.01); *G09G 2320/0247* (2013.01); *G09G 2320/041* (2013.01); *G09G 2320/064* (2013.01); *G09G 2330/021* (2013.01); *G09G 2330/028* (2013.01); *G09G 2340/0435* (2013.01)

(58) Field of Classification Search
USPC ..... 345/691
See application file for complete search history.

(56) References Cited

U.S. PATENT DOCUMENTS 9,721,509 B2 8/2017 Kim et al.
2014/0111490 A1* 4/2014 Lee ..... G09G 3/3266 345/204

(Continued)

FOREIGN PATENT DOCUMENTS

KR 10-0741977 B1 7/2007
KR 10-2015-0078818 A 7/2015

(Continued)

*Primary Examiner* — Chineyere D Wills-Burns
(74) *Attorney, Agent, or Firm* — Lewis Roca Rothgerber Christie LLP

(57) ABSTRACT

An organic light-emitting diode (OLED) display device including: a display panel including a plurality of pixels and light emission control transistors; a data driver configured to supply data signals to the pixels through data lines; a scan driver configured to supply scan signals to the pixels through scan lines; a temperature detector; a first power supply configured to supply drive voltages to the pixels; a light emission controller configured to set the light emission control transistors to a turned-on state; and a timing controller configured to determine a drive mode of the display panel, wherein the scan driver and the data driver supply scan signals and data signals to the pixels at a first frame frequency in a first drive mode, and to supply scan signals and data signals to the pixels at a second frame frequency, lower than the first frame frequency, in a second drive mode.

16 Claims, 8 Drawing Sheets

(56) References Cited

U.S. PATENT DOCUMENTS

| | | | | |
|---|---|---|---|---|
| 2015/0206502 | A1* | 7/2015 | Hwang | G09G 3/3618 345/213 |
| 2015/0213747 | A1* | 7/2015 | Adamovich | G09G 3/2003 345/691 |
| 2016/0005365 | A1* | 1/2016 | Choi | G09G 3/2007 345/690 |
| 2016/0179179 | A1* | 6/2016 | An | G06F 1/3265 345/212 |
| 2017/0004772 | A1* | 1/2017 | Han | G09G 3/3258 |
| 2017/0116922 | A1* | 4/2017 | Jung | G09G 3/3258 |
| 2017/0206837 | A1 | 7/2017 | Jeon | |

FOREIGN PATENT DOCUMENTS

| | | | |
|---|---|---|---|
| KR | 10-2015-0146117 | A | 12/2015 |
| KR | 10-2017-0086761 | | 7/2017 |

* cited by examiner

Fig. 8

Driving Mode 2 Frame Rate:10Hz

| Temperature Level | VINIT2 | ELVSS2 | EM_ON min | EM_ON max |
|---|---|---|---|---|
| 50 ≦ Tp | -2V | 0V | 1ms | 3ms |
| Tp = 40 | -2.4V | -0.5V | 1ms | 2.7ms |
| Tp = 30 | -2.7V | -1V | 1ms | 2.3ms |
| Tp = 20 | -3V | -1.5V | 1ms | 2ms |
| Tp = 10 | -3.3V | -2V | 1ms | 2ms |
| Tp = 0 | -3.3V | -2.5V | 1ms | 2ms |
| Tp ≦ -10 | -3.3V | -2.5V | 1ms | 2ms |

Fig. 9

Driving Mode 2 Frame Rate:5Hz

| Temperature Level | VINIT | ELVSS | EM_ON min | EM_ON max |
|---|---|---|---|---|
| 50 < Tp | -0.5V | 0V | 2ms | 6ms |
| Tp = 40 | -1.0V | -0.5V | 2ms | 5.4ms |
| Tp = 30 | -1.5V | -1V | 2ms | 4.6ms |
| Tp = 20 | -2.0V | -1.5V | 2ms | 4ms |
| Tp = 10 | -2.5V | -2V | 2ms | 4ms |
| Tp = 0 | -3.0V | -2.5V | 2ms | 4ms |
| Tp < -10 | -3.3V | -2.5V | 2ms | 4ms |

DISPLAY DEVICE AND METHOD OF DRIVING THE SAME

CROSS-REFERENCE TO RELATED APPLICATION

This application claims priority to and the benefit of Korean Patent Application No. 10-2017-0046243, filed on Apr. 10, 2017, in the Korean Intellectual Property Office (KIPO), the disclosure of which is incorporated by reference herein.

BACKGROUND

1. Field

The present disclosure relates to a display device and a method of driving the same.

2. Discussion of Related Art

An organic light-emitting diode (OLED) display device is a device that displays images by using organic light-emitting diodes (OLEDs). In a mobile device, such as a smartphone, an OLED display device may operate in an always on display (AOD) mode in order to display a clock. In the AOD mode, the OLED display device operates at a longer frame frequency than in a general operation mode. When a frame frequency is set to 30 Hz or lower, flickers may be exhibited by the OLED display device. Furthermore, a problem may arise in that occurrence of flickers becomes severe due to an ambient temperature condition.

It is to be understood that this background of the technology section is intended to provide useful background for understanding the technology and as such disclosed herein, the technology background section may include ideas, concepts or recognitions that were not part of what was known or appreciated by those skilled in the pertinent art prior to an effective filing date of the subject matter disclosed herein.

SUMMARY

Aspects of the present disclosure are directed to an OLED display device and a method of driving the same, which are capable of preventing flickers from occurring while reducing power consumption in an always on display (AOD) mode.

According to some embodiments of the present disclosure, there is provided an organic light-emitting diode (OLED) display device including: a display panel including a plurality of pixels each of which includes an OLED configured to emit light based on a drive current, and light emission control transistors connected to the OLED; a data driver configured to supply data signals to the pixels through data lines; a scan driver configured to supply scan signals to the pixels through scan lines; a temperature detector configured to detect an ambient temperature; a first power supply configured to supply drive voltages to the pixels; a light emission controller configured to set the light emission control transistors to a turned-on state; and a timing controller configured to control the data driver, the scan driver, the temperature detector, and the light emission controller, and to determine a drive mode of the display panel, wherein the scan driver and the data driver are configured to supply scan signals and data signals to the pixels at a first frame frequency in a first drive mode, and to supply scan signals and data signals to the pixels at a second frame frequency, lower than the first frame frequency, in a second drive mode, wherein the light emission controller is configured to supply light emission control signals, having a frequency two or more times the second frame frequency during each frame, to the light emission control transistors in the second drive mode, and wherein the light emission control signals have ON times which are variable based on the temperature detected by the temperature detector.

In some embodiments, the light emission control signals have long ON times proportional to the temperature in the second drive mode.

In some embodiments, ON times of the light emission control signals sequentially increase within one frame in the second drive mode.

In some embodiments, the OLED display device further includes a lighting look-up table including set values of at least one of frequencies, voltages, and ON times of the light emission control signals.

In some embodiments, the lighting look-up table has set values of the light emission control signals corresponding to the second frame frequency.

In some embodiments, the timing controller is configured to calculate a new set value by interpolating between stored set temperature values close to the measured temperature when the measured temperature has not been stored in the lighting look-up table, and the light emission controller is configured to generate and output the light emission control signals based on the new set value.

In some embodiments, the light emission control transistors are connected in series to the OLED.

According to some embodiments of the present disclosure, there is provided an organic light-emitting diode (OLED) display device including: a display panel including: a plurality of pixels each including a storage capacitor; a switching transistor connected to the storage capacitor and a scan line; light emission control transistors connected to source and drain terminals of the switching transistor; an initialization transistor connected to the storage capacitor; an OLED configured to emit light based on a drive current passing through the light emission control transistors; and data lines and scan lines connected to the pixels; a data driver configured to supply data signals to the pixels through the data lines; a scan driver configured to supply scan signals to the pixels through the scan lines; a temperature detector configured to detect an ambient temperature; a first power supply configured to supply a first drive high voltage, a first drive low voltage, and a first initialization voltage; a second power supply configured to supply a second drive high voltage, a second drive low voltage, and a second initialization voltage; a timing controller configured to control the data driver, the scan driver, the temperature detector, the light emission controller, and the power selector, and to determine a drive mode of the display panel; and a power selector configured to selectively connect output power of the first power supply and output power of the second power supply to the pixels according to the drive mode received from the timing controller, wherein the scan driver and the data driver are configured to respectively supply scan signals and data signals to the pixels at a first frame frequency in a first drive mode, and to respectively supply scan signals and data signals to the pixels at a second frame frequency lower than the first frame frequency in a second drive mode, wherein the light emission controller is configured to supply light emission control signals, having a frequency two or more times the second frame frequency during each frame, to the light emission control transistors in the second drive mode, and wherein the second power supply is configured to adjust at least one of the second drive low voltage and the second initialization voltage based on the temperature, detected by the temperature detector, in the second drive mode.

In some embodiments, the second power supply is configured to output at least one of the second drive low voltage and the second initialization voltage at a voltage value, increasing in proportion to the measured temperature, in the second drive mode.

In some embodiments, the second power supply is configured to adjust at least one output voltage of the second initialization voltage and the second drive low voltage during a frame period in the second drive mode.

In some embodiments, the second power supply is configured to output at least one of the second initialization voltage and the second drive low voltage at a higher voltage value at an end point of a frame than at a start point of the frame in the second drive mode.

In some embodiments, the second power supply is configured to provide a voltage holding interval, during which at least one output voltage of the second initialization voltage and the second drive low voltage is held during a period of time, in the second drive mode.

In some embodiments, the OLED display device further includes a lighting look-up table including set voltage values of at least one of the second initialization voltage and the second drive low voltage.

In some embodiments, the power selector is configured: to supply the first initialization voltage to the initialization transistor in the first drive mode; and to supply the second initialization voltage to the initialization transistor in the second drive mode.

In some embodiments, the power selector is configured: to supply the first drive low voltage to the pixels in the first drive mode; and to supply the second drive low voltage to the pixel in the second drive mode.

In some embodiments, the second drive low voltage is connected to a cathode terminal of the OLED.

In some embodiments, the second power supply is integrally formed with the data driver.

BRIEF DESCRIPTION OF THE DRAWINGS

An appreciation of the present disclosure by a person of ordinary skill in the art will become more apparent by describing in detail exemplary embodiments thereof with reference to the accompanying drawings, wherein:

FIG. 8 illustrates stored data of a lighting look-up table according to an exemplary embodiment of the present disclosure; and FIG. 9 illustrates stored data of a lighting look-up table according to an exemplary embodiment of the present disclosure.

DETAILED DESCRIPTION

Figure 1:
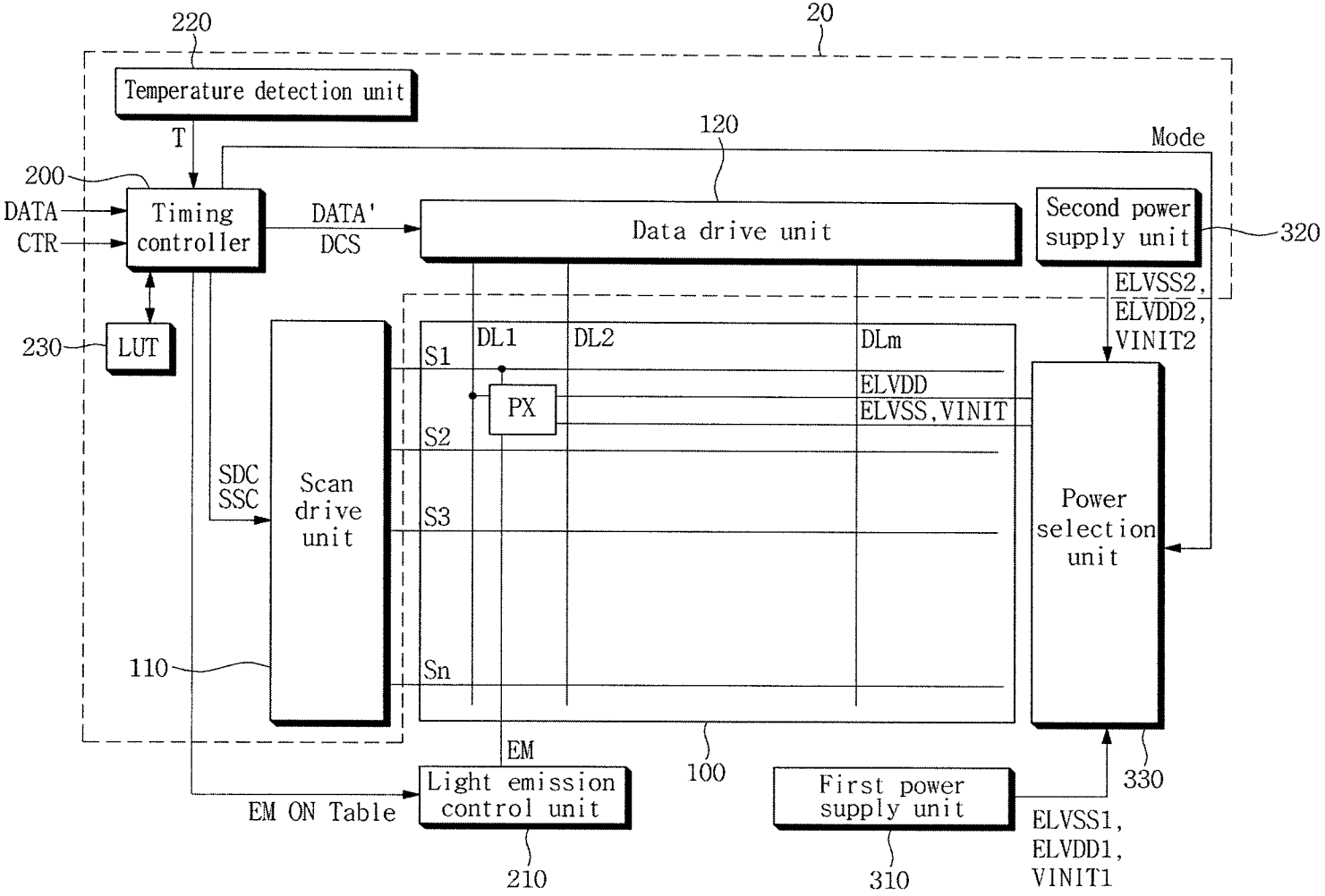
FIG. 1 is a block diagram illustrating an OLED display device according to an exemplary embodiment of the present disclosure.

Aspects and features of the present disclosure and methods for achieving them will be made clear from exemplary embodiments described below in detail with reference to the accompanying drawings. The present disclosure may, however, be embodied in many different forms and should not be construed as being limited to the exemplary embodiments set forth herein. Rather, these exemplary embodiments are provided so that this disclosure will be thorough and complete, and will fully convey the scope of the present disclosure to those skilled in the art. The present disclosure is merely defined by the scope of the claims. Therefore, well-known constituent elements, operations and techniques may not be described in detail in the exemplary embodiments in order to avoid obscuring the present disclosure. Like reference numerals refer to like elements throughout the specification.

Unless otherwise defined, all terms used herein (including technical and scientific terms) have the same meaning as commonly understood by those skilled in the art to which this present disclosure pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

FIG. 1 is a block diagram illustrating an OLED display device 10 according to an exemplary embodiment of the present disclosure.

Referring to FIG. 1, the OLED display device 10 according to the present exemplary embodiment includes a display panel 100, a scan drive unit (e.g., a scan driver) 110, a data drive unit (e.g., a data driver) 120, a timing controller (T-CON) 200, a light emission control unit (e.g., a light emission controller) 210, a first power supply unit (e.g., a first power supply) 310, a second power supply unit (e.g., a second power supply) 320, and a power selection unit (e.g., a power selector) 330.

The display panel 100 includes: a plurality of scan lines S1 to Sn; a plurality of data lines D1 to Dm configured to be insulated from and cross the plurality of scan lines S1 to Sn; and a plurality of pixels PX electrically connected to the plurality of scan lines S1 to Sn and the plurality of data lines D1 to Dm. The plurality of scan lines S1 to Sn are connected to the scan drive unit 120, and the plurality of data lines D1 to Dm are connected to the data drive unit 110.

Meanwhile, a display drive unit (e.g., a display driver) 20 may include the scan drive unit 110, the data drive unit 120, the timing controller, the light emission control unit 210, and the second power supply unit 320.

The scan drive unit 110 may generate scan signals under the control of the timing controller 200, and may supply the generated scan signals to the scan lines S1 to Sn.

Accordingly, the individual pixels PXL may receive scan signals through the scan lines S1 to Sn.

The scan drive unit 110 may sequentially generate scan signals in response to a scan drive control signal SDC and a scan shift clock SSC from the timing controller 200, and may supply the scan signals to the scan lines S1 to Sn.

The data drive unit 120 includes a plurality of data drive integrated circuits (ICs). The data drive unit 120 may receive corrected image data DATA' and a data drive control signal DCS from the timing controller 200, and may generate data signals in response to the corrected image data DATA' and the data drive control signal DCS. The data drive unit 120 generates sampled image data by sampling the corrected image data DATA' in response to the data drive control signal DCS, and supplies the sampled image data to the data lines D1 to Dm each time the scan signal is applied.

The first power supply unit 310 generates first drive power, including a first drive high voltage ELVDD1 to be applied to an anode terminal of an OLED of each pixel, a first drive low voltage ELVSS1 to be applied to a cathode terminal of the pixel, and a first initialization voltage VINIT1 to be connected to initialization transistors T6, and T7 of the pixel.

The first drive high voltage ELVDD1 and the first drive low voltage ELVSS1 may be set to different voltages. For example, the first drive high voltage ELVDD1 may be set to a positive voltage, and the first drive low voltage ELVSS1 may be set to a negative voltage or ground voltage.

The second power supply unit 320 generates second drive power, including a second drive high voltage ELVDD2 to be applied to an anode terminal of an OLED of each pixel, a second drive low voltage ELVSS2 to be applied to a cathode terminal of the pixel, and a second initialization voltage VINIT2 to be connected to the initialization transistors T6 and T7 of the pixel. The second power supply unit 320 is a power source used in a standby mode, has a lower output current than the first power supply unit 310, and may be formed unitarily with (e.g., be structurally integrated with) the data drive unit 120.

The power selection unit 330 may select one of output power of the first power supply unit 310 and output power of the second power supply unit 320 under the control of the timing controller 200, and may supply the selected output power to the pixels PX. The power selection unit 330 selects a power supply unit according to a drive mode DM of the OLED display device 10, a detailed description of which will be given later.

The light emission control unit 210 generates a light emission control signal EM to be applied to a gate terminal of a light emission control transistor connected in series to an OLED of each pixel. Light emission control transistors (see, e.g., T4 and T5 of FIG. 2) may block a drive current to be supplied to a light emitting element EL located in the pixel PX.

The display device 10 may further include a temperature detection unit (e.g., a temperature detector) 220. The temperature detection unit 220 may convert a detected temperature (e.g., a measured temperature) into an electric signal, and may transmit the resulting electric signal to the timing controller 200. The temperature detection unit 220 may include a metallic resistor, a resistance value of which varies (e.g., in a predictable manner) with a change in temperature.

The timing controller 200 may control the scan drive unit 110, the data drive unit 120, the light emission control unit 210, the power selection unit 330, the first power supply unit 310, and the second power supply unit 320.

The timing controller 200 may convert image data DATA, supplied from the outside (e.g., external to the timing controller 200 or the display device 10), according to specifications of the data drive unit 120, and may supply corrected image data DATA' to the data drive unit 120.

Furthermore, the timing controller 200 may generate a data drive unit control signal DCS by using a control signal CTR supplied from the outside, and may control an operation of the data drive unit 120 by supplying the data drive unit control signal DCS to the data drive unit 120.

The timing controller 200 may select drive power to be applied to the display panel 100 by controlling the power selection unit 330 through supply of a drive mode DM (e.g., a drive mode signal) to the power selection unit 330.

Furthermore, the timing controller 200 detects (e.g., determines) a temperature of the display panel 100 via the temperature detection unit 220, and outputs a set value EM_ON_Table of a light emission control signal EM for (e.g., corresponding to or associated with) the detected temperature (e.g., measured temperature) to the light emission control unit 210 by referring to a lighting look-up table LUT 230. The light emission control unit 210 generates a light emission control signal EM according to the received set value EM_ON_Table of the light emission control signal, and supplies the light emission control signal EM to the display panel 100. Referring to FIG. 8, the lighting look-up table LUT 230 stores a minimum value EM_ON min and maximum value EM_ON max value of light emission control signals EM for each temperature. The timing controller 200 may calculate ON times (ON1 to ON5) of the light emission control signals EM based on the number of light emission control signals EM applied based on the minimum value EM_ON min and maximum value EM_ON max of the light emission control signals EM. The calculated ON times (ON1 to ON5) are output to the light emission control unit 210.

In some examples, the lighting look-up table LUT 230 may store all the values of ON times (ON1 to ON5) of the light emission control signals EM.

Figure 2:
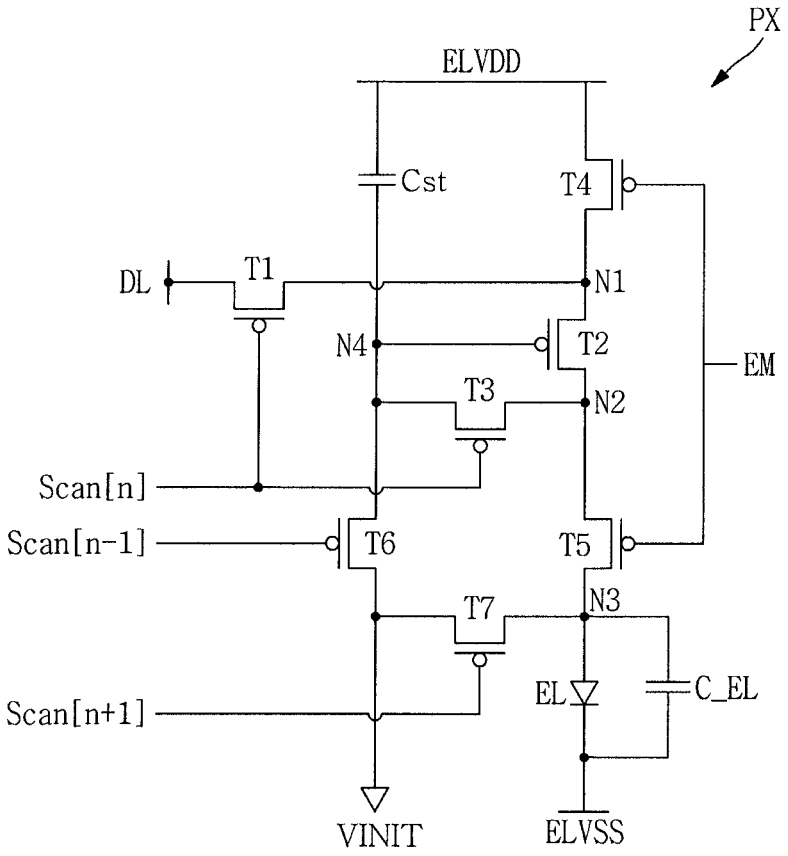
FIG. 2 illustrates a pixel structure of an OLED display device according to an exemplary embodiment of the present disclosure.

FIG. 2 illustrates a pixel structure of an OLED display device according to an exemplary embodiment of the present disclosure.

Referring to FIG. 2, each pixel PX may include a first transistor T1, a second transistor T2, a third transistor T3, a storage capacitor Cst, a fourth transistor T4, a fifth transistor T5, a sixth transistor T6, a seventh transistor T7, and a light emitting element EL.

The first transistor T1 may be connected between a data line and a first node N1, and may be turned on in response to a scan signal GW. The second transistor T2 may be connected between the first node N1 and a second node N2, and may be turned on in response to a voltage of a fourth node N4. A third transistor T3 may be connected between the second node N2 and the fourth node N4, and may be turned on in response to a scan signal Scan[n]. The storage capacitor Cst may be connected between a first power voltage ELVDD and the fourth node N4. When the first to third transistors T1 to T3 are turned on in response to the scan signal Scan[n], the storage capacitor Cst may be charged with a voltage corresponding to a data signal supplied through the data line. The fourth transistor T4 may be connected between the first power voltage ELVDD and the first node N1, and the fifth transistor T5 may be connected between the second node N2 and the light emitting element EL. The fourth transistor T4 and the fifth transistor T5 are turned on in response to a light emission control signal EM, and may provide a drive current, corresponding to the voltage with which the storage capacitor Cst has been charged, to the light emitting element EL along with the second transistor T2. The second transistor is also called a drive transistor, and the fourth transistor T4 and the fifth transistor T5 are also called light emission control transistors.

The light emitting element EL emits light at a luminance corresponding to the drive current. The light emitting element EL may include a parasitic capacitor C_EL. While the light emitting element EL is emitting light according to the drive current, the parasitic capacitor C_EL may be charged with a voltage which is applied to the light emitting element EL.

The sixth transistor T6 may be connected between the fourth node N4 and the initialization voltage VINIT, and may be turned on in response to a pre-scan signal Scan[n−1] used as a first initialization signal. When the sixth transistor T6 is turned on, the voltage with which the storage capacitor Cst has been charged may be initialized to the initialization voltage VINIT. In other words, power is discharged from the storage capacitor Cst according to initialization voltage VINIT. The seventh transistor T7 may be connected between the third node N3 and the initialization voltage VINIT, and may be turned on in response to a post-scan signal Scan[n+1] used as a second initialization signal. In this case, separate initialization signals may be applied instead of the pre-scan signal Scan[n−1] and the post-scan signal Scan[n+1]. When the seventh transistor T7 is turned on, the voltage with which the parasitic capacitor C_EL has been charged may be initialized according to the initialization voltage VINIT. In other words, power may be discharged from the parasitic capacitor C_EL according to the initialization voltage VIN IT.

The display device 10 according to the embodiment of the present disclosure may operate in a first drive mode in which a frame frequency is equal to or higher than 60 Hz and a second drive mode in which a frame frequency is equal to or lower than 30 Hz.

When the display device 10 operates in the second drive mode, the voltage with which the storage capacitor Cst has been charged is continuously discharged according to the initialization voltage VINIT. During each frame period, a luminance of the display panel 100 is also decreased in response to a decrease in a charged voltage of the storage capacitor Cst. In the second drive mode, flickers may be exhibited by the display panel 100 because a difference in luminance between start and end points of a frame is increased due to a low frame frequency. In order to remove or reduce flickers, a drive voltage may be varied or light emission timing of the display device may be changed. However, in this case, when an ambient temperature changes, there occur cases where characteristics of internal transistors of pixels are changed, and thus flickers may once again become perceivable.

In the display device 10 according to the exemplary embodiment of the present disclosure, flickers are prevented from occurring or are reduced in the second drive mode DM2 by means of a lighting look-up table LUT adapted to store optimum drive voltages and light emission conditions for changes in temperature.

Figure 3A:
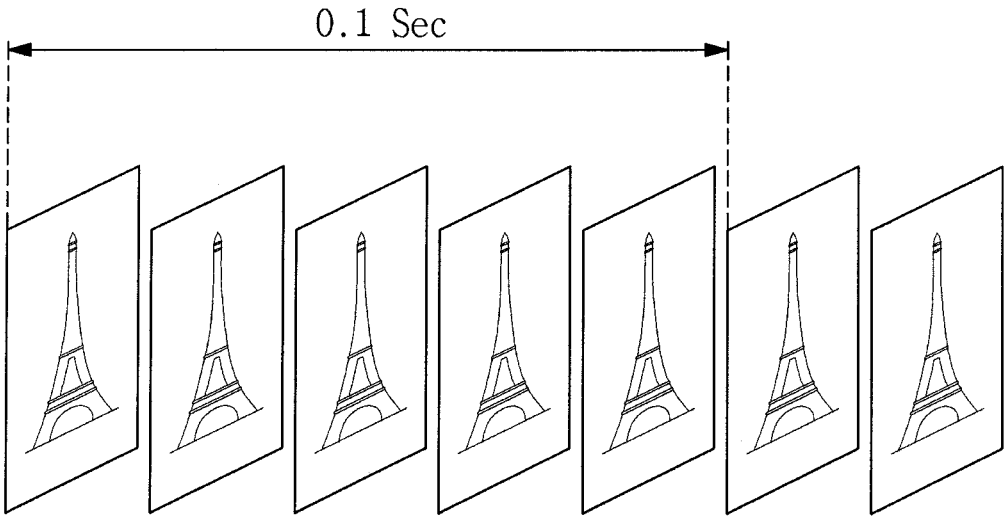
FIGS. 3*a*-3*b* are schematic diagrams of frames of an OLED display device.
Figure 3B:
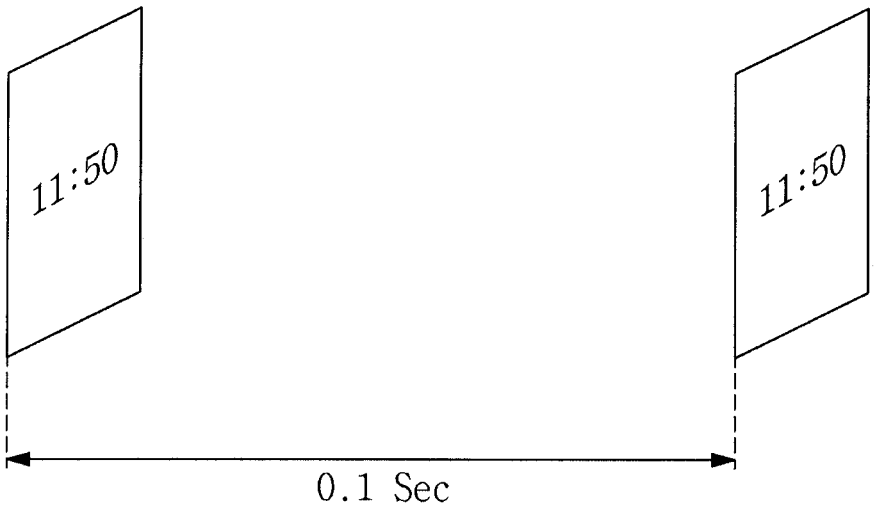

FIGS. 3*a* and 3*b* are schematic diagrams of frames of an OLED display device. FIG. 3*a* illustrates an image display operation of the OLED display device 10 in the first drive mode DM1, and FIG. 3*b* illustrates an image display operation of the OLED display device 10 in the second drive mode DM2.

The OLED display device 10 according to the exemplary embodiment of the present disclosure may operate in the first drive mode DM1 and the second drive mode DM2, which are distinctive from each other.

The first drive mode DM1 is a mode in which common images are displayed, and may provide various images to a user by using an overall display area of the OLED display device 10. In this case, the first drive mode DM1 may be referred to as a "general drive mode."

The second drive mode DM2 is a mode in which a standby image is displayed, and the standby image may be displayed in a partial display area of the OLED display device 10.

For example, the standby image may represent abbreviated information. For example, information, such as a date, time, weather, or the like, may be included in the standby image. Furthermore, a numeral, text, a diagram, an icon, or the like representative of specific information may be included in the standby image.

In this case, the second drive mode DM2 may be referred to as a "standby drive mode."

For example, the OLED display device 10 may enter into the first drive mode DM1 or second drive mode DM2 in response to a request from a user.

Furthermore, when there has not been an input of a user in the first drive mode DM1 during a set or predetermined period of time, a drive mode may be switched to the second drive mode DM2.

Conditions for entry into the drive modes DM1 and DM2 and conditions for switch between the drive modes DM1 and DM2 may be set in various suitable manners.

Referring to FIG. 3*a*, the OLED display device 10 may display images at a first frame frequency during the first drive mode DM1.

For example, the display drive unit 20 may identify a current drive mode DM based on a signal input from the outside, and may control the OLED display device 10 so that images can be displayed at the first frame frequency when the current drive mode DM is identified as the first drive mode DM1.

For example, when the first frame frequency is set to 60 Hz, the OLED display device 10 may display six frames during a period of 0.1 seconds. For this purpose, the display drive unit 20 may operate in each of 60 frame periods during one second.

The first frame frequency is not limited to 60 Hz, and may be set to various suitable values, such as 120 Hz, 240 Hz, etc.

Referring to FIG. 2*b*, the OLED display device 10 may display images at a second frame frequency during the second drive mode DM2. For example, the display drive unit 20 may identify a current drive mode based on a signal input from the outside, and may control the OLED display device 10 so that images can be displayed at the second frame frequency when the current drive mode is identified as the second drive mode DM2. It is sufficient if only a relatively simple standby image is displayed in the second drive mode DM2. In this case, it may be desirable to perform low-frequency driving in order to reduce power consumption.

Accordingly, the second frame frequency may be set to a frequency value lower than the first frame frequency.

For example, when the first frame frequency is set to 60 Hz, the second frame frequency may be set to 10 Hz, in which case the display panel 10 may display ten frames during one second.

For this purpose, the display drive unit 20 normally operates and displays corresponding frames during some (e.g., a first frame period) of 60 frame periods during one second.

Figure 4:
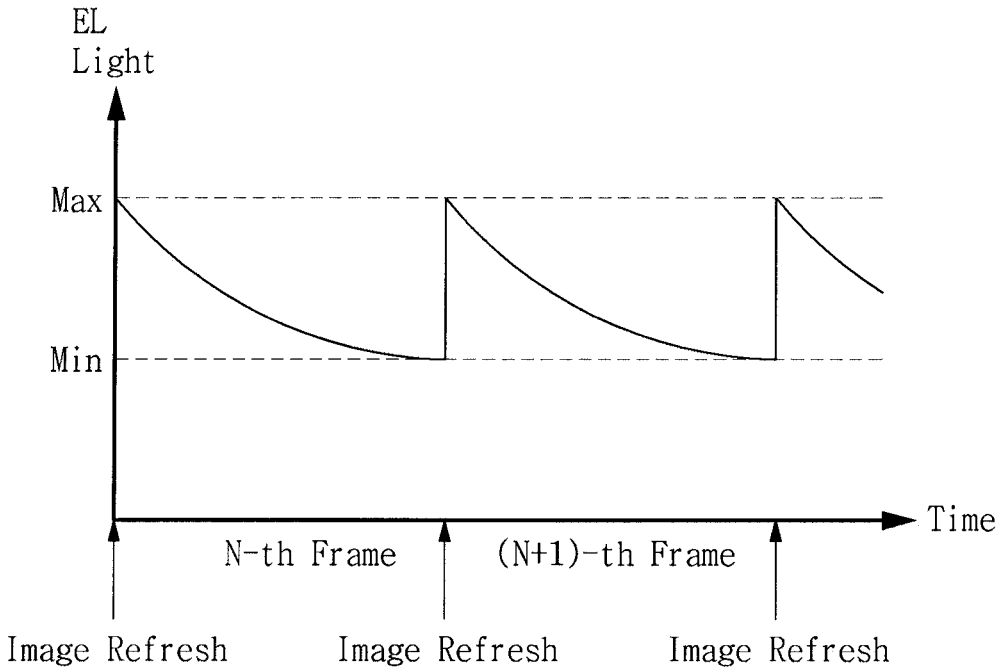
FIG. 4 illustrates optical output waveforms of an OLED display device during a low-frequency operation, according to an exemplary embodiment of the present disclosure.

FIG. 4 illustrates optical output waveforms of an OLED display device during a low-frequency operation.

During a low-frequency operation of the OLED display device 10, a drive current may be decreased due to a hysteresis characteristic of the drive transistor T2 and a leak of charges of the storage capacitor Cst.

Referring to FIG. 4, a decrease in drive current results in a decrease in optical output EL Light of each light emitting element. While an N-th frame continues after an image has been refreshed at a start point of the N-th frame, optical output of the light emitting element EL is continuously decreased. In a subsequent (N+1)-th frame, the image is refreshed, and the optical output of the light emitting element EL is increased again.

In the case where a frame frequency of the OLED display device 10 is equal to or higher than 50 Hz, even when a decrease in drive current occurs, a length of each frame is short, and thus a difference in luminance between start and end points of the frame may not be great. Accordingly, in the OLED display device 10 operating at a frame frequency equal to or higher than 50 Hz, flickers attributable to a decrease in drive current may be rarely visible.

However, when the OLED display device 10 is driven at a low frame frequency equal to or lower than 30 Hz in order to perform low-power consumption driving, an output luminance of the light emitting element EL becomes a maximum luminance Max at a start point of the frame, and becomes a minimum luminance Min at an end point of the frame, as illustrated in FIG. 4. In other words, output luminance of the display panel 100 repeatedly increases and decreases in each frame, and thus flickers may be exhibited by the OLED display device 10.

Figure 5:
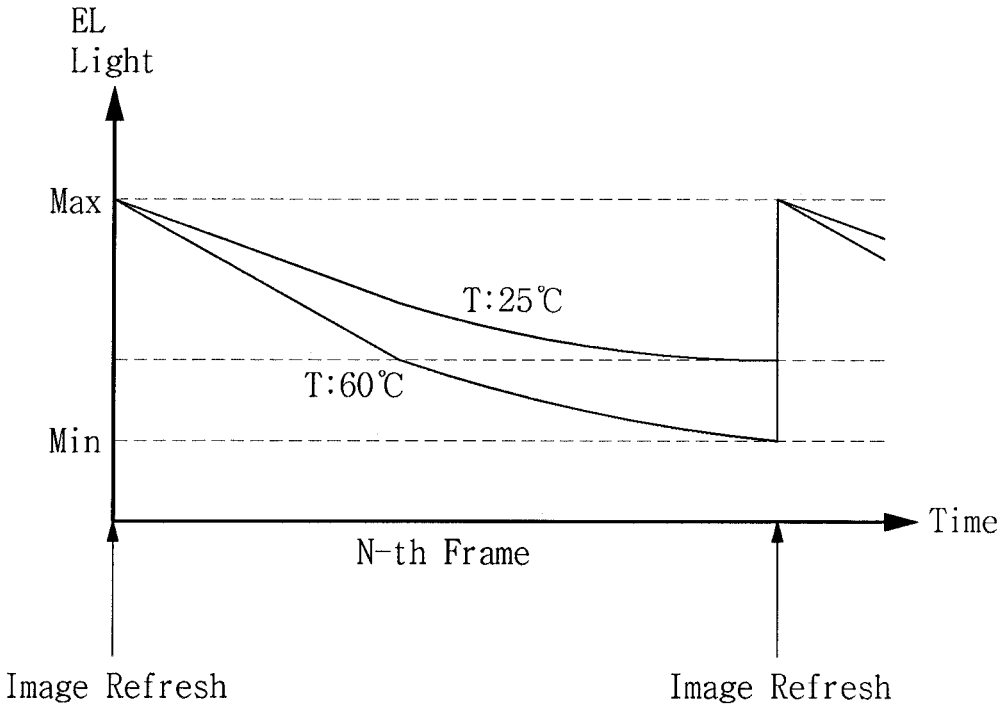
FIG. 5 illustrates optical output waveforms during a low-frequency driving mode based on temperatures of an OLED display device, according to an exemplary embodiment of the present disclosure.

FIG. 5 illustrates optical output waveforms during a low-frequency driving mode based on temperatures of an OLED display device.

In the OLED display device 10, a drive current may be decreased due to a hysteresis characteristic of the drive transistor T2 and a leakage current of the storage capacitor Cst according to a change in temperature.

Referring to FIG. 5, an optical output in a case where the OLED display device 10 operates at a temperature of 25° C. is denoted by T:25, and an optical output in a case where the OLED display device 10 operates at a temperature of 60° C. is denoted by T:60. In the display panel 100, an image formed by a scan signal and a data signal is refreshed in an initial interval of a frame. Immediately or soon after the image has been refreshed, the OLED display device 10 emits light at a maximum luminance Max, and there is rarely a difference in luminance attributable to temperature.

In some examples, when one frame continues and an image is continuously displayed, the amount of leakage current of the storage capacitor Cst may vary with temperature. An optical output EL Light of each light-emitting element is more rapidly decreased during an operation at a temperature of 60° C. than during an operation at a temperature of 25° C.

A difference in optical output EL Light of the light-emitting element attributable to temperature is largest at an end point of a frame.

Furthermore, when a subsequent frame (an (N+1)-th frame) starts after one frame has ended, an image is refreshed. The OLED display device 10 displays a maximum-luminance (Max) image at a start point of the frame (the (N+1)-th frame).

Accordingly, in the second drive mode DM2, as a temperature of the OLED display device 10 rises, a difference between a maximum luminance Max and a minimum luminance Min increases in proportion to a length of a single frame, and thus flickers may occur.

FIGS. 6*a*-6*d* are diagrams illustrating examples of light emission of an OLED display device according to a first exemplary embodiment of the present disclosure.

Figure 6A:
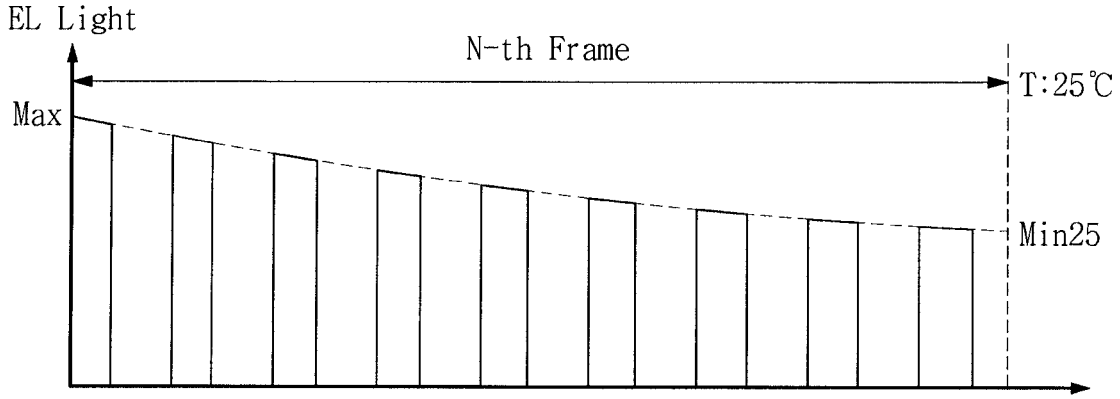
FIGS. 6*a*-6*d* are diagrams illustrating examples of light emission of an OLED display device according to a first exemplary embodiment of the present disclosure.
Figure 6B:
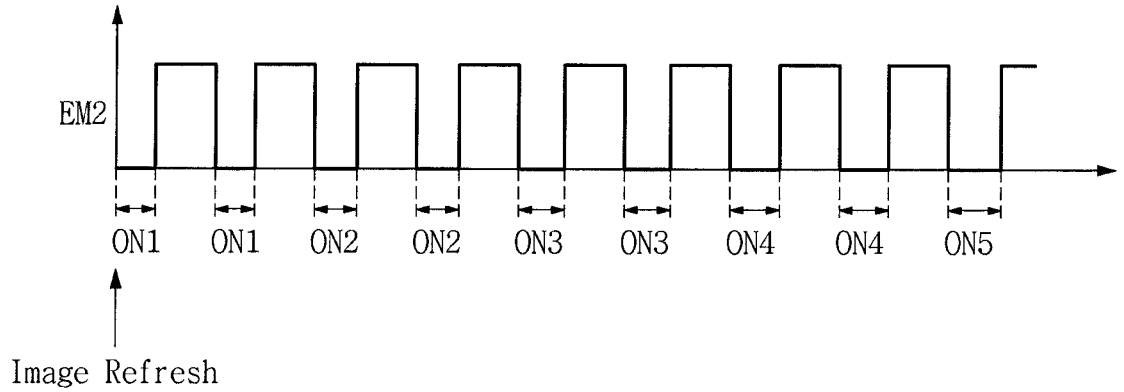

Referring to FIGS. 6*a*-6*b*, in the second drive mode DM2, a plurality of light emission control signals EM adapted to control light emission of pixels are applied to the pixels during an N-th frame. Light emission control transistors T4 and T5 of the pixels are implemented as n-channel metal oxide-semiconductors (NMOS) transistors, and are turned on when the light emission control signals EM are in their low state. However, embodiments of the present invention are not limited thereto.

The light emission control signals EM have their ON times ON1 to ON5, and a plurality of light emission control signals EM having the same ON time may be applied one after another. Because an image is not refreshed in the middle of one frame, the light emission control signals EM allow pixels, corresponding to an image that is refreshed at a start point of the frame in the OLED display device 10, to emit light. Scan and data signals adapted to refresh an image are supplied at the second frame frequency, while the light emission control signals EM have a frequency that is at least twice the second frame frequency. The OLED display device 10 may suppress occurrence of flickers by repeatedly turning emission ON and OFF in response to the light emission control signals EM.

Even when the OLED display device 10 performs display at the frequency of the light emission control signals EM, a luminance of a displayed image is decreased toward an end of the frame due to a decrease in luminance of light emission.

The light emission control signals EM may have sequentially increasing ON times ON1 to ON5 within one frame period. Furthermore, successively applied light emission control signals EM may have the same ON times.

Because the OLED display device 10 performs display at a maximum luminance in an early part of a frame, it may display an image according to light emission control signals EM having shorter ON times (e.g., ON1, and ON2). In the later part of the frame where a drive current is decreased and an output luminance is low, the OLED display device 10 may display an image according to light emission control signals EM having longer ON times (e.g., ON4, and ON5).

When a user perceives an image, he or she perceives it by accumulating instantaneous luminances and light emission times of the image being displayed. Accordingly, when ON times ON1 to ON5 of light emission control signals EM to be applied in the later part of the frame are increased, the user may perceive a small difference in luminance between an image displayed in the early part of the frame and an image displayed in the later part of the frame.

Figure 6C:
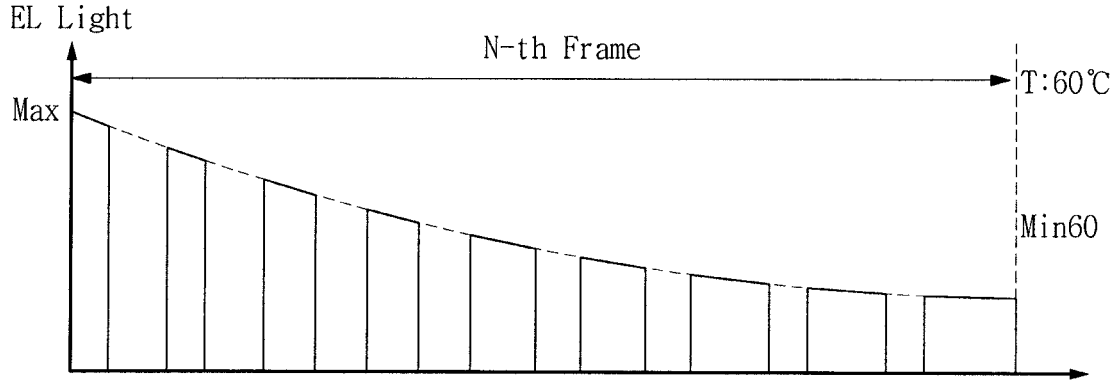
Figure 6D:
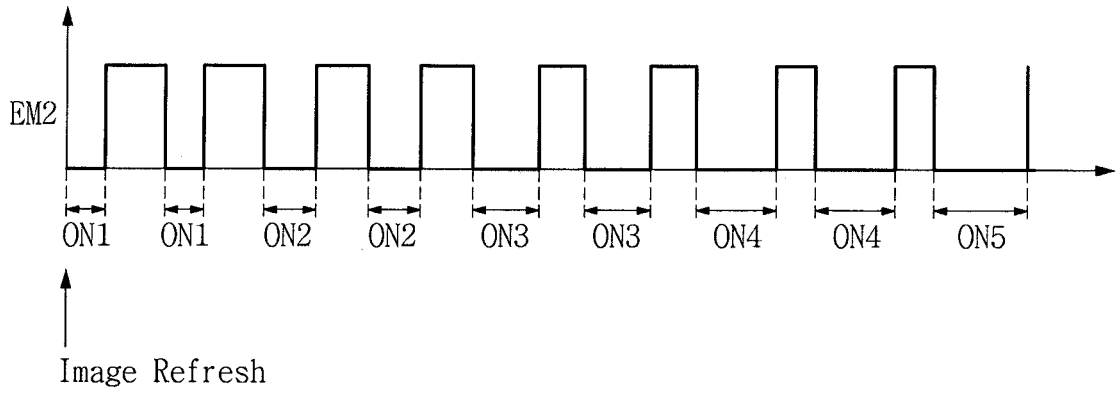

Referring to FIGS. 6*c*-6*d*, as an ambient temperature of the OLED display device 10 increases, a leakage of a charged voltage of the storage capacitor Cst may increase. As a result, attenuation of a drive current in the frame of the OLED display device 10 may be also increased in a high-temperature environment. In this case, the light emission control unit 210 may remove flickers of the OLED display device 10 by further increasing ON times ON1 to ON5 of the light emission control signal EMs.

Figure 7A:
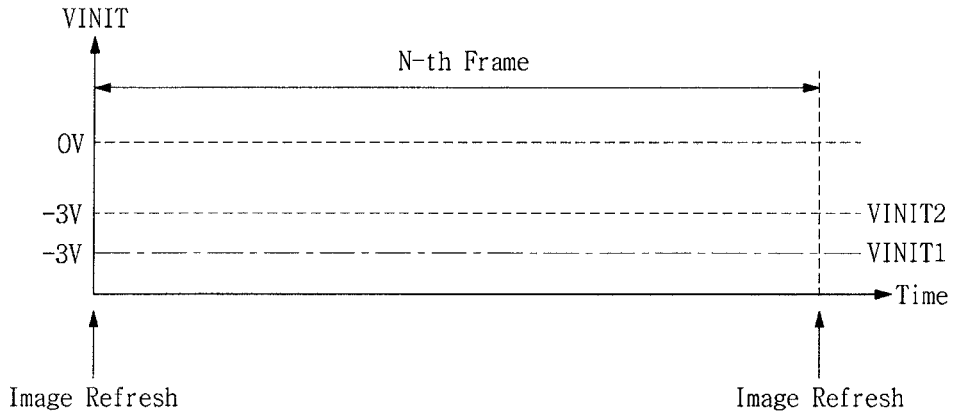
FIG. 7*a* is a diagram illustrating examples of initialization voltages of an OLED display device according to a second exemplary embodiment of the present disclosure.

FIG. 7*a* is a diagram illustrating examples of initialization voltages of an OLED display device according to a second exemplary embodiment of the present disclosure.

Figure 7B:
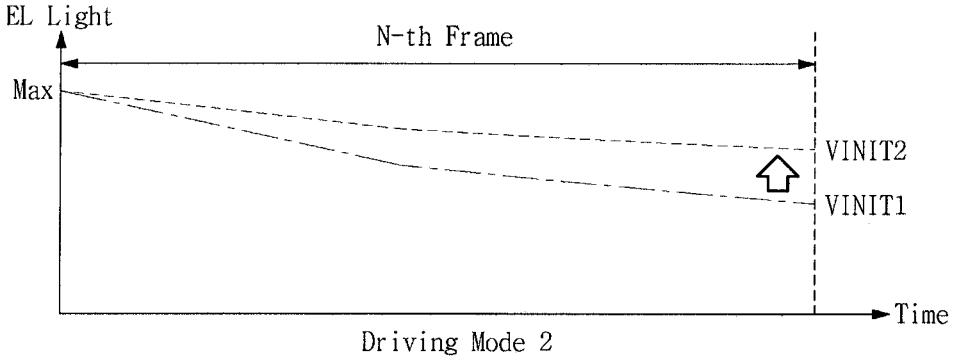
FIG. 7*b* is a diagram illustrating an example of light emission of the OLED display device according to the second exemplary embodiment of the present disclosure.

FIG. 7*b* is a diagram illustrating an example of light emission of the OLED display device according to the second exemplary embodiment of the present disclosure.

Figure 7C:
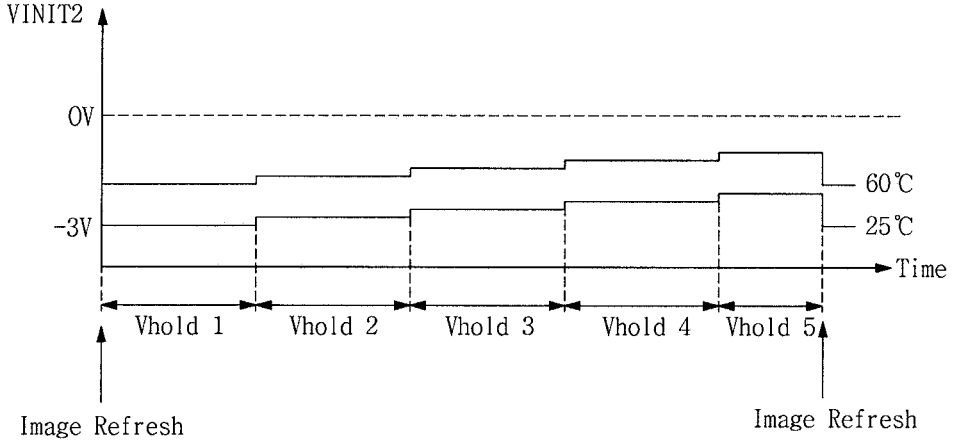
FIG. 7*c* is a diagram illustrating examples of initialization voltages of an OLED display device according to an exemplary embodiment of the present disclosure.

FIG. 7*c* is a diagram illustrating examples of initialization voltages of an OLED display device according to another exemplary embodiment of the present disclosure.

Referring to FIGS. 7*a* and 7*b*, according to an operating mode of the OLED display device 10, the power selection unit 330 selects any one of the first initialization voltage VINIT1 and the second initialization voltage VINIT2, and supplies the selected voltage to the display panel 100.

When the OLED display device 10 operates in the first drive mode DM1, the power selection unit 330 selects the first power supply unit 310, and supplies the first initialization voltage VINIT1 to the display panel 100. In some examples, when the OLED display device 10 operates in the second drive mode DM2, the power selection unit 330 selects the second power supply unit 320, and supplies the second initialization voltage VINIT2 to the display panel 100. The first initialization voltage VINIT1 and the second initialization voltage VINIT2 may have negative voltages.

Referring to FIG. 2, the storage capacitor Cst may store a voltage corresponding to a data signal. When the OLED display device 10 operates at a low frame frequency, such as that in the second drive mode DM2, the voltage stored in the storage capacitor Cst may be leaked through the sixth transistor T6 or seventh transistor T7. A leakage current increases as a voltage of the second initialization voltage VINIT2 connected to the sixth transistor T6 or seventh transistor T7 becomes lower.

As illustrated in FIG. 7*a*, the second initialization voltage VINIT2 has a voltage higher than the first initialization voltage VINIT1. A flicker phenomenon attributable to a decrease in luminance generated in a later part of a frame may be suppressed by applying the second initialization voltage VINIT2 higher than the first initialization voltage VINIT1 in the second drive mode DM2.

FIG. 7*c* is a waveform diagram of initialization voltages according to still another exemplary embodiment of the present disclosure.

Referring to FIG. 7*c*, the second power supply unit 320 may output the second initialization voltage VINIT2 adapted to hold a set or predetermined voltage during a voltage holding period Vhold. Furthermore, the second power supply unit 320 may vary (e.g., adjustor set) the second initialization voltage VINIT2 based on a temperature detected by the temperature detection unit 220, and may output the varied second initialization voltage. When a temperature increases, a leakage current may increase further, and thus the higher second initialization voltage VINIT2 may be supplied to the display panel 100.

Furthermore, the second initialization voltage VINIT2 to be applied in each of voltage holding periods Vhold1 to Vhold5 may be sequentially increased over one frame period. A difference in electric potential between the second initialization voltage VINIT2 and the voltage stored in the storage capacitor Cst is decreased, thereby preventing or substantially preventing a drive current from leaking through the sixth transistor T6 or seventh transistor T7.

FIG. 8 illustrates stored data of a lighting look-up table LUT according to an exemplary embodiment of the present disclosure.

Referring to FIG. 8, the lighting look-up table LUT includes second initialization voltages VINIT2, second drive low voltages ELVSS2, light emission control signal ON time minimum values EM_ON min, and light emission control signal ON time maximum values EM_ON max based on temperatures when the display panel 100 operates in the second drive mode DM2 and the second frame frequency is 10 Hz.

Each of the second initialization voltages VINIT2 has a negative voltage value, has a higher value as a temperature increases, and may be maintained at a voltage of −3.3 V when the temperature is equal to or lower than 10° C.

Each of the second drive low voltages ELVSS2 has a negative voltage value, has a higher value as a temperature increases, and may be maintained at a voltage of −2.5 V when the temperature is equal to or lower than 0° C.

Each of the light emission control signal ON time minimum values EM_ON min is an ON time of a light emission control signal EM at a start point of a frame, and each of the light emission control signal ON time maximum values EM_ON max is an ON time of a light emission control signal EM at an end point of the frame.

The timing controller 200 may generate light emission control signals to be applied to pixels during a frame period from the light emission control signal ON time minimum values EM_ON min and the light emission control signal ON time maximum values EM_ON max stored in the lighting look-up table LUT.

The lighting look-up table LUT may store ON times of the respective light emission control signals EM.

FIG. 9 illustrates stored data of a lighting look-up table LUT according to an exemplary embodiment of the present disclosure.

Referring to FIG. 9, the lighting look-up table LUT includes second initialization voltages VINIT2, second drive low voltages ELVSS2, light emission control signal ON time minimum values EM_ON min, and light emission control signal ON time maximum values EM_ON max based on temperatures when the display panel 100 operates in the second drive mode DM2 and the second frame frequency is 5 Hz.

When the second frame frequency of the display panel 100 is 5 Hz, a length of one frame is 200 ms. As a holding period of the frame is increased, the second initialization voltages VINIT2, the second drive low voltages ELVSS2, the light emission control signal ON time minimum values EM_ON min, and the light emission control signal ON time maximum values EM_ON max stored in the lighting look-up table LUT may vary.

FIGS. 8 and 9 are merely examples of a lighting look-up table LUT. It will be apparent that set values stored in a lighting look-up table LUT may include set values of other parameters according to characteristics of the display panel 100, such as a structure and physical properties of the display panel 100.

The OLED display device according to the present disclosure can prevent flickers from occurring, or reduce instances thereof, due to temperature during low-frequency driving for low power consumption.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

It will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ.

Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention, such as the temperature detector, the timing controller, the first and second power supplies, the power selector, the light emission controller, etc., described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

While the present disclosure has been illustrated and described with reference to the exemplary embodiments thereof, it will be apparent to those of ordinary skill in the art that various suitable changes in form and detail may be made thereto without departing from the spirit and scope of the present disclosure as defined by the following claims and equivalents thereof.

What is claimed is:

1. An organic light-emitting diode (OLED) display device comprising:

a display panel comprising a plurality of pixels each of which comprises an OLED configured to emit light based on a drive current, and light emission control transistors connected to the OLED;

a data driver configured to supply data signals to the pixels through data lines;

a scan driver configured to supply scan signals to the pixels through scan lines;

a temperature detector configured to detect an ambient temperature;

a first power supply configured to supply drive voltages to the pixels;

a light emission controller configured to set the light emission control transistors to a turned-on state; and a timing controller configured to control the data driver, the scan driver, the temperature detector, and the light emission controller, and to determine a drive mode of the display panel, wherein the scan driver and the data driver are configured to supply scan signals and data signals to the pixels at a first frame frequency in a first drive mode, and to supply scan signals and data signals to the pixels at a second frame frequency, lower than the first frame frequency, in a second drive mode, wherein the light emission controller is configured to supply light emission control signals, having a frequency two or more times the second frame frequency during each frame, to the light emission control transistors in the second drive mode, wherein the light emission control signals have ON times during which the light emission control transistors are turned on, and wherein in the second drive mode, a length of the ON times at an end point of each frame increase as a temperature detected by the temperature detector increases.

2. The OLED display device according to claim 1, wherein ON times of the light emission control signals sequentially increase within one frame in the second drive mode.

3. The OLED display device according to claim 1, further comprising a lighting look-up table comprising set values of at least one of frequencies, voltages, and ON times of the light emission control signals.

4. The OLED display device according to claim 3, wherein the lighting look-up table has set values of the light emission control signals corresponding to the second frame frequency.

5. The OLED display device according to claim 3, wherein the timing controller is configured to calculate a new set value by interpolating between stored set temperature values close to the detected temperature when the detected temperature has not been stored in the lighting look-up table, and wherein the light emission controller is configured to generate and output the light emission control signals based on the new set value.

6. The OLED display device according to claim 1, wherein the light emission control transistors are connected in series to the OLED.

7. An organic light-emitting diode (OLED) display device comprising:

a display panel comprising:

a plurality of pixels each comprising a storage capacitor;

a switching transistor connected to the storage capacitor and a scan line;

light emission control transistors connected to source and drain terminals of the switching transistor;

an initialization transistor connected to the storage capacitor;

an OLED configured to emit light based on a drive current passing through the light emission control transistors; and data lines and scan lines connected to the pixels;

a data driver configured to supply data signals to the pixels through the data lines;

a scan driver configured to supply scan signals to the pixels through the scan lines;

a temperature detector configured to detect an ambient temperature;

a first power supply configured to supply a first drive high voltage, a first drive low voltage, and a first initialization voltage;

a second power supply configured to supply a second drive high voltage, a second drive low voltage, and a second initialization voltage;

a timing controller configured to control the data driver, the scan driver, the temperature detector, a light emission controller, and a power selector, and to determine a drive mode of the display panel; and the power selector configured to selectively connect output power of the first power supply and output power of the second power supply to the pixels according to the drive mode received from the timing controller, wherein the scan driver and the data driver are configured to respectively supply scan signals and data signals to the pixels at a first frame frequency in a first drive mode, and to respectively supply scan signals and data signals to the pixels at a second frame frequency lower than the first frame frequency in a second drive mode, wherein the light emission controller is configured to supply light emission control signals, having a frequency two or more times the second frame frequency during each frame, to the light emission control transistors in the second drive mode, and wherein the second power supply is configured to adjust at least one of the second drive low voltage and the second initialization voltage based on a temperature, detected by the temperature detector, in the second drive mode.

8. The OLED display device according to claim 7, wherein the second power supply is configured to output at least one of the second drive low voltage and the second initialization voltage at a voltage value, increasing in proportion to the detected temperature, in the second drive mode.

9. The OLED display device according to claim 8, wherein the second power supply is configured to adjust at least one output voltage of the second initialization voltage and the second drive low voltage during a frame period in the second drive mode.

10. The OLED display device according to claim 9, wherein the second power supply is configured to output at least one of the second initialization voltage and the second drive low voltage at a higher voltage value at an end point of a frame than at a start point of the frame in the second drive mode.

11. The OLED display device according to claim 10, wherein the second power supply is configured to provide a voltage holding interval, during which at least one output voltage of the second initialization voltage and the second drive low voltage is held during a period of time, in the second drive mode.

12. The OLED display device according to claim 8, further comprising a lighting look-up table comprising set voltage values of at least one of the second initialization voltage and the second drive low voltage.

13. The OLED display device according to claim 8, wherein the power selector is configured:

to supply the first initialization voltage to the initialization transistor in the first drive mode; and to supply the second initialization voltage to the initialization transistor in the second drive mode.

14. The OLED display device according to claim 8, wherein the power selector is configured:

to supply the first drive low voltage to the pixels in the first drive mode; and to supply the second drive low voltage to the pixels in the second drive mode.

15. The OLED display device according to claim 14, wherein the second drive low voltage is connected to a cathode terminal of the OLED.

16. The OLED display device according to claim 7, wherein the second power supply is integrally formed with the data driver.

* * * * *